US007543362B2

(12) United States Patent
Olechowski

(10) Patent No.: US 7,543,362 B2
(45) Date of Patent: Jun. 9, 2009

(54) METHOD FOR PREVENTING SLIDER CLIP RELEASE

(75) Inventor: Kevin P. Olechowski, Bourbonnais, IL (US)

(73) Assignee: Illinois Tools Works Inc., Glenview, IL (US)

( * ) Notice: Subject to any disclaimer, the term of this patent is extended or adjusted under 35 U.S.C. 154(b) by 219 days.

(21) Appl. No.: 11/595,260

(22) Filed: Nov. 9, 2006

(65) Prior Publication Data

US 2008/0112652 A1 May 15, 2008

(51) Int. Cl.

| | |
|---|---|
| ***A44B 19/16*** | (2006.01) |
| ***B65D 33/16*** | (2006.01) |
| ***B65D 50/00*** | (2006.01) |
| ***B65D 33/34*** | (2006.01) |

(52) U.S. Cl. ..... 24/399; 24/400; 383/64; 383/5

(58) Field of Classification Search ..... 24/399–402, 24/405, 585.1, 585.12, 30.5 R; 383/64, 66
See application file for complete search history.

(56) References Cited

U.S. PATENT DOCUMENTS

| | | | | |
|---|---|---|---|---|
| 5,442,837 | A * | 8/1995 | Morgan | 24/400 |
| 5,924,173 | A * | 7/1999 | Dobreski et al. | 24/400 |
| 5,964,532 | A * | 10/1999 | St. Phillips et al. | 383/5 |
| 6,231,236 | B1 * | 5/2001 | Tilman | 383/63 |
| 6,286,999 | B1 * | 9/2001 | Cappel et al. | 24/400 |
| 6,464,394 | B1 * | 10/2002 | Galomb | 24/30.5 R |
| 6,955,465 | B2 * | 10/2005 | Machacek et al. | 24/585.12 |
| 2003/0228076 | A1 | 12/2003 | Plourde et al. | |
| 2004/0062457 | A1 | 4/2004 | Plourde | |
| 2006/0171610 | A1 | 8/2006 | Buchman et al. | |
| 2007/0098305 | A1 * | 5/2007 | Tilman | 24/400 |

FOREIGN PATENT DOCUMENTS

| | | |
|---|---|---|
| EP | 1 251 075 A2 | 10/2002 |
| WO | WO 00/67605 | 11/2000 |
| WO | WO 2004/043812 A1 | 5/2004 |

* cited by examiner

*Primary Examiner*—Robert J Sandy
(74) *Attorney, Agent, or Firm*—Day Pitney LLP

(57) ABSTRACT

The present disclosure relates to a zipper for a reclosable package or bag and a method of forming thereof, wherein aligned apertures are cut into the zipper flanges proximate to the slider position when the package or bag is open. Portions of the front and rear walls of the package or bag extend through these apertures during the original manufacture of the bag, and are sealed to each other during the same sealing operation which seals the front and rear walls of the package or bag to the flanges of the zipper. The resulting seal between the front and rear walls, extending through the apertures in the zipper flanges, prevents the zipper profiles from opening in the portion where the slider is positioned when the reclosable package or bag is open.

18 Claims, 2 Drawing Sheets

METHOD FOR PREVENTING SLIDER CLIP RELEASE

BACKGROUND OF THE INVENTION

1. Field of the Invention

The present invention pertains to a method and apparatus for preventing the accidental release of slider clips on zippered reclosable packages or bags, particularly packages or bags which require the consumer to tear a tamper-evident portion after the initial opening of the zipper.

2. Description of the Prior Art

In the prior art, it is known to provide a reclosable package or bag with a tamper-evident zipper wherein the initial opening of the zipper provide access to a segment of film which must be torn to provide access to the product therein. This segment of film may include an area of weakness such as a perforated line or a score line. Alternatively, a peel seal may join to segments of film. However, such a configuration may lead the consumer to use considerable force separating the zipper profiles, thereby projecting the slider clip into the air and away from the bag. This may even cause the slider clip to shatter. Such an event not only destroys the reclosable capability of the zipper but also may present a choking hazard for young children.

OBJECTS AND SUMMARY OF THE INVENTION

It is therefore an object of the present invention to provide a method and apparatus to prevent the accidental release and ejection of a slider clip from a reclosable zippered package or bag, particularly when the user is tearing the tamper-evident element after the initial opening of the reclosable zipper.

It is therefore a further object of the present invention to obtain the above object with minimal added complexity and cost to the manufacturing process.

These and other objects are attained by providing an aperture through the zipper profiles at a location immediately below where the slider clip is located when the zipper is open. This results in the front and rear walls of the package or bag extending through the aperture and being sealed to each other. This resulting seal forms a station which prevents the separation of the zipper profiles in the area where the slider clip is located when the zipper is in its open configuration, thereby preventing the accidental release and ejection of the slider clip.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
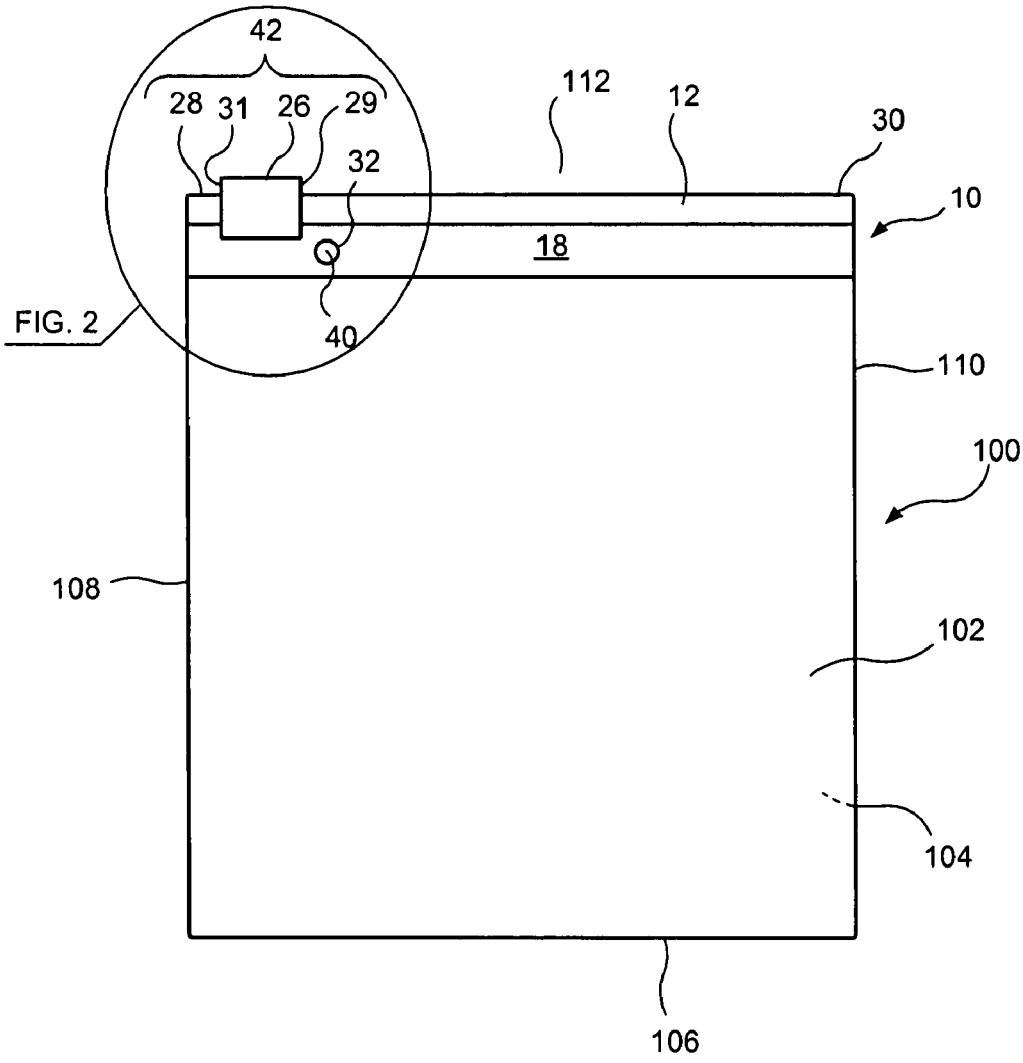
FIG. 1 is a plan view of a reclosable package or bag, incorporating the zipper of the present invention.
Figure 3:
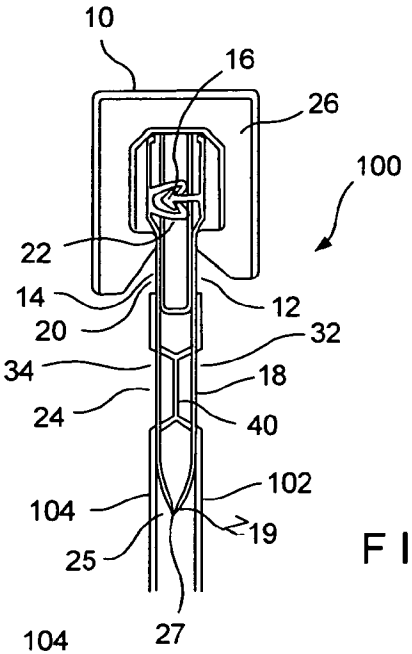
FIG. 3 is a cross-sectional view along plane 3-3 of FIG. 2.

Referring now to the drawings in detail wherein like numerals indicate like elements throughout the several views, one sees that FIG. 1 is a plan view of a typical reclosable package 100 which includes the zipper 10 of the present invention. Reclosable package or bag 100 includes front and rear walls 102, 104 formed from sheets of polymeric web or film, joined by a bottom seal 106 and side seals 108, 110 thereby forming a mouth 112. In some embodiments, seal 106 or seals 108, 110 may be replaced by a fold thereby allowing front and rear walls 102, 104 to be formed from a single sheet of polymeric web or film. Zipper 10 is likewise typically formed from polymeric or plastic material and includes first and second interlocking zipper profiles 12, 14. First interlocking zipper profile 12 includes first interlocking element 16 (illustrated in FIG. 3 as a male element) and first flange 18. Second interlocking zipper profile 14 includes second interlocking element 22 (illustrated in FIG. 3 as a female element) and second flange 24. First and second flanges 18, 24 are sealed to the interior of respective front and rear walls 102, 104 immediately adjacent to mouth 112 thereby making package or bag 100 reclosable. As shown in FIG. 3, lower ends 19, 25 of first and second flanges 18, 24 are formed at frangible tamper-evident line of weakness 27. Tamper-evident line of weakness 27 may be a perforated line, scoring, or a peel seal between two separate flanges. This tamper-evident line of weakness 27 is torn or broken after initial opening of zipper 10, typically by the consumer. Those skilled in the art will recognize that various tamper-evident or similar configurations may be combined with the present invention, or even omitted.

Figure 2:
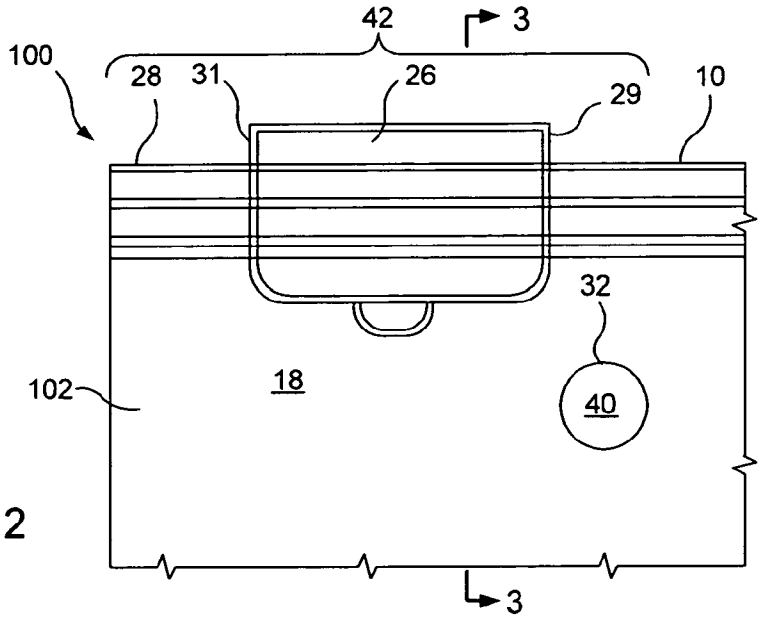
FIG. 2 is an area of detail of FIG. 1.
Figure 4:
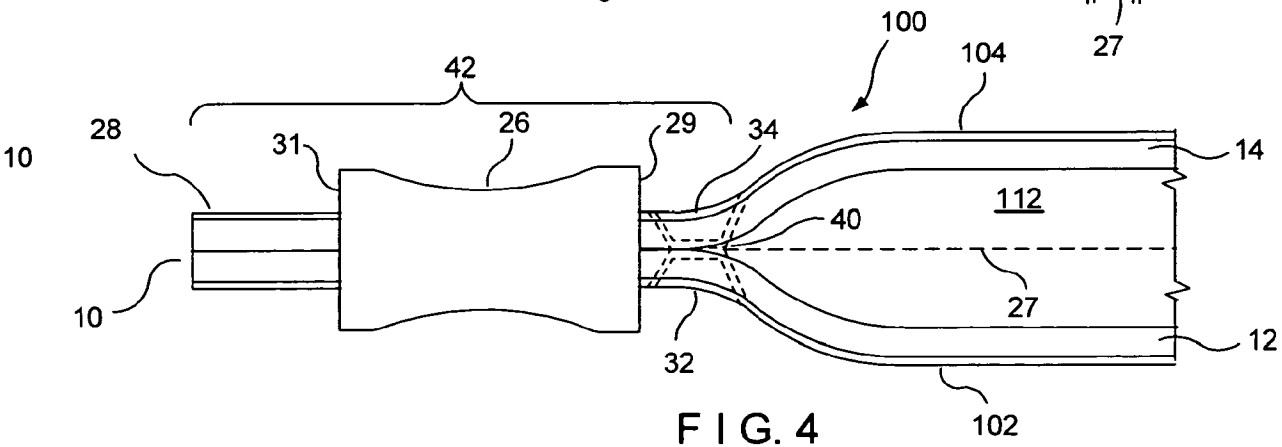
FIG. 4 is a top plan view of the area of detail shown in FIG. 2.

Zipper 10 further includes slider 26 which is mounted on first and second interlocking zipper profiles 12, 14 and operates to separate interlocking zipper profiles 12, 14 when moved in an opening direction and to interlock zipper profiles 12, 14 when moved in a closing direction. Slider 26 includes an opening end 29 wherein the first and second zipper profiles 12, 14 are separated and closing end 31 wherein the first and second zipper profiles 12, 14 are interlocked (as shown in FIGS. 3 and 4). Zipper 10 further includes a first end 28 and a second end 30 wherein first and second interlocking profiles 12, 14 are typically sealed together proximate to side seals 108, 110, respectively. When slider 26 is positioned at first end 28 (as shown in FIGS. 1 and 2), zipper 10, and hence mouth 112, is open at least between slider 26 and second end 30. Likewise, when slider 26 is positioned at second end 30, zipper 10, and hence mouth 112, is closed at least between slider 26 and first end 28.

First aperture 32 is formed in first flange 18 and is aligned with second aperture 34 which is formed in second flange 24. First and second apertures 32, 34 are aligned in the view of FIGS. 1 and 2 and are formed proximate to the first end 28 of zipper 10. First and second apertures 32, 34 are typically formed by punching, but may be formed by other similar methods.

During the original manufacture of reclosable bag or package 100, when the interior sides of front and rear walls 102, 104 are sealed to first and second flanges 18, 24, the interior of the first and second flanges 18, 24 are typically coated with anti-seal coatings to prevent the sealing of flanges 18, 24 to each other through the central portions thereof. However, as portions of the first and second flanges 18, 24 are removed by the formation of first and second apertures 32, 34, portions of front and rear walls 102, 104 extend through first and second apertures 32, 34, contact each other in the absence of anti-seal coatings, and are sealed to each other, typically during the same sealing operation which seals the interior sides of front and rear walls 102, 104 to first and second flanges 18, 24 thereby forming seal portion 40 as shown in FIGS. 1-4. This seal portion 40 (between the portions of front and rear walls 102, 104 extending through apertures 32, 34) maintains first and second zipper profiles 12, 14 in engagement with each other between seal portion 40 and the first end 28 of reclosable package or bag 10. This forms a slider station 42 wherein first and second zipper profiles 12, 14 will not separate thereby preventing a slider 26 in this station 42 from shattering or being projected from reclosable package or bag 100.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper for a reclosable package or bag, including:

a first interlocking profile including a first interlocking element and a first package-engaging flange, the first package-engaging flange being below the first interlocking element;

a second interlocking profile including a second interlocking element and a second package-engaging flange, the second package-engaging flange being below the second interlocking element;

a slider mounted on the first and second interlocking profiles, wherein moving the slider in a closing direction causes the first and second interlocking profiles to interlock with each other and moving the slider in an opening direction causes the first and second interlocking profiles to separate from each other;

the first and second interlocking profiles being joined to each other at a first end and a second end, wherein when the slider is positioned proximate to the first end, the first and second interlocking profiles are separated between the slider and the second end, and wherein when the slider is positioned proximate to the second end, the first and second interlocking profiles are interlocked between the slider and the first end; and the first package-engaging flange including a first aperture proximate to the first end and the second package-engaging flange including a second aperture proximate to the first end;

wherein the first aperture allows a first portion of web to extend through the first aperture and wherein the second aperture allows a second portion of web to extend through the second aperture.

2. The zipper of claim 1 wherein the first aperture is aligned with the second aperture.

3. The zipper of claim 1 further including a tamper-evident element.

4. The zipper of claim 3 wherein the first and second package-engaging flanges are joined, thereby forming the tamper-evident element.

5. The zipper of claim 4 wherein the first and second package-engaging flanges are joined by an element chosen from the group consisting of a perforated line, a scored line and a peel seal.

6. A package including;

first and second sheets of web forming walls of the package; and a zipper including:

a first interlocking profile including a first interlocking element and a first flange, the first flange sealed to the first sheet of web;

a second interlocking profile including a second interlocking element and a second flange, the second flange sealed to the second sheet of web;

a slider mounted on the first and second interlocking profiles, wherein moving the slider in a closing direction causes the first and second interlocking profiles to interlock with each other and moving the slider in an opening direction causes the first and second interlocking profiles to separate from each other;

the first and second interlocking profiles being joined to each other at a first end and a second end, wherein when the slider is positioned proximate to the first end, the first and second interlocking profiles are separated between the slider and the second end, and wherein when the slider is positioned proximate to the second end, the first and second interlocking profiles are interlocked between the slider and the first end; and the first flange including a first aperture proximate to the first end and the second package-flange including a second aperture proximate to the first end;

wherein the first aperture allows a portion of the first sheet of web to extend through the first aperture and wherein the second aperture allows a portion of the second sheet of web to extend through the second aperture; and wherein the portion of the first sheet of web is sealed to the portion of the second sheet of web along a seal portion.

7. The package of claim 6 wherein the seal portion is formed by a same sealing operation which seals the first and second sheets of web to the first and second flanges, respectively.

8. The package of claim 7 wherein the seal portion urges the first and second interlocking profiles together in an area between the seal portion and the first end of the zipper.

9. The package of claim 8 wherein the area of the first and second interlocking profiles between the seal portion and the first end of zipper forms a station for the slider when the slider is proximate to the first end of the zipper.

10. A zipper for a reclosable package or bag, including:

a first profile including a first upper portion and a first lower portion;

a second profile including a second upper portion and a second lower portion;

a slider mounted on the first and second upper portions, wherein moving the slider in a closing direction causes the first and second profiles to interlock with each other and moving the slider in an opening direction causes the first and second profiles to separate from each other;

the first and second profiles being joined to each other at a first end and a second end, the first lower portion including a first aperture proximate to the first end and the second lower portion including a second aperture proximate to the first end; and wherein the first aperture allows a first portion of web to extend through the first aperture and wherein the second aperture allows a portion of web to extend through the second aperture.

11. The zipper of claim 10 wherein the first aperture is aligned with the second aperture.

12. The zipper of claim 10 further including a tamper-evident element.

13. The zipper of claim 12 wherein the first and second lower portions are frangibly joined, thereby forming the tamper-evident element.

14. The zipper of claim 13 wherein the first, and second lower portions are frangibly joined by an element chosen from the group consisting of a perforated line, a scored line and a peel seal.

15. A package including;

first and second sheets of web forming walls of the package; and a zipper including:

a first profile including a first upper portion and a first lower portion, the first lower portion engaging the first sheet;

a second profile including a second upper portion and a second lower portion, the second lower portion engaging the second sheet;

a slider mounted on the first and second upper portions, wherein moving the slider in a closing direction causes the first and second profiles to interlock with each other and moving the slider in an opening direction causes the first and second profiles to separate from each other;

the first and second profiles being joined to each other at a first end and a second end; and the first lower portion including a first aperture proximate to the first end and the second lower portion including a second aperture proximate to the first end;

wherein the first aperture allows a portion of the first sheet of web to extend through the first aperture and wherein the second aperture allows a portion of the second sheet of web to extend through the second aperture; and wherein the portion of the first sheet of web is sealed to the portion of the second sheet of web along a seal portion.

16. The package of claim 15 wherein the seal portion is formed by a same sealing operation which seals the first and second sheets of web to the first and second upper portions, respectively.

17. The package of claim 16 wherein the seal portion urges the first and second profiles together in an area between the seal portion and the first end of the zipper.

18. The package of claim 17 wherein the area of the first and second profiles between the seal portion and the first end of zipper forms a station for the slider when the slider is proximate to the first end of the zipper.

* * * * *